US007000364B2

(12) United States Patent
Middelberg et al.

(10) Patent No.: US 7,000,364 B2
(45) Date of Patent: Feb. 21, 2006

(54) APPARATUS AND METHOD FOR STUFFING A FOLDER

(75) Inventors: Neal J. Middelberg, Apex, NC (US); Gerard A. DeRome, Jr., Cary, NC (US); Barry D. Hageter, Cary, NC (US)

(73) Assignee: Bowe Bell + Howell Company, Durham, NC (US)

( * ) Notice: Subject to any disclaimer, the term of this patent is extended or adjusted under 35 U.S.C. 154(b) by 0 days.

(21) Appl. No.: 10/273,464

(22) Filed: Oct. 18, 2002

(65) Prior Publication Data

US 2003/0121236 A1 Jul. 3, 2003

Related U.S. Application Data

(60) Provisional application No. 60/344,695, filed on Oct. 19, 2001.

(51) Int. Cl.
*B65B 43/26* (2006.01)

(52) U.S. Cl. ..... 53/381.7; 53/251; 53/255; 53/386.1; 53/389.1

(58) Field of Classification Search ..... 53/457, 53/459, 460, 468, 469, 474, 251, 255, 259, 53/260, 381.7, 382.1, 386.1, 393, 389.1, 53/537, 540, 238; 198/644; 270/52.14, 270/52.19, 52.23, 52.24, 52.26, 52.27, 52.1, 270/52.2

See application file for complete search history.

(56) References Cited

U.S. PATENT DOCUMENTS 3,934,867 A 1/1976 Oeschger, Jr.
3,965,644 A * 6/1976 Stocker ..... 53/457
3,999,701 A 12/1976 Ward
4,055,932 A * 11/1977 Wanner ..... 53/381.7
4,071,997 A * 2/1978 Gunther et al. ..... 53/389.1
4,085,927 A * 4/1978 Muller ..... 271/6
4,295,643 A 10/1981 de la Vega
4,955,185 A * 9/1990 Haas et al. ..... 53/460
5,107,656 A 4/1992 Katz et al.
5,388,388 A * 2/1995 Belec et al. ..... 53/460
5,475,968 A 12/1995 Linder
5,560,185 A * 10/1996 Petkovsek ..... 53/460
5,618,375 A * 4/1997 Suzuki et al. ..... 53/381.7
5,823,320 A 10/1998 Seidel et al.
5,898,153 A * 4/1999 Lagan et al. ..... 235/375
6,059,093 A * 5/2000 Merkli ..... 198/644
6,116,652 A * 9/2000 Page ..... 283/45
6,311,968 B1 11/2001 Linder et al.
6,327,042 B1 12/2001 Krasuski et al.
6,666,610 B1 * 12/2003 Moor et al. ..... 402/79

* cited by examiner

*Primary Examiner*—Louis Huynh
(74) *Attorney, Agent, or Firm*—McDermott Will & Emery LLP

(57) ABSTRACT

A novel apparatus and method of automatically stuffing folder pockets includes providing a folder with one or more pockets; providing one or more inserts which can be of differing sizes; the accumulation of the one or more inserts in a stack for insertion into the one or more pockets of the folder; opening the one or more pockets of the folder; and the insertion of the accumulated stack of the one or more inserts into the one or more folder pockets. Predetermined inserts can be selectively processed and stuffed into selected folder pockets. An embodiment also can fold the folder, producing a final product of a stuffed folder ready for distribution.

23 Claims, 12 Drawing Sheets

APPARATUS AND METHOD FOR STUFFING A FOLDER

RELATED APPLICATIONS

This application claims the benefit of U.S. Provisional Patent Application Ser. No. 60/344,695, filed Oct. 19, 2001; the disclosure of which is incorporated herein by reference in its entirety.

TECHNICAL FIELD

The present invention relates generally to stuffing folders. More particularly, the present invention relates to an apparatus and method for automatically stuffing folder pockets.

BACKGROUND ART

A variety of machines and methods exist for the stuffing of envelopes or other closed-end products. U.S. Pat. No. 4,055,932 to Wanner discloses an envelope stuffing machine adapted to insert sheets of paper or the like between the sides of a cover which can be drawn apart by suction to accommodate the sheets. The device further comprises a pair of opposite perforated surfaces connected to a suction chamber and between which the envelope is introduced so as to draw the opposite sides of the envelope apart to receive the sheets to be inserted.

Additionally, U.S. Pat. No. 3,999,701 to Ward; U.S. Pat. No. 5,107,656 to Katz et al.; and U.S. Pat. No. 5,475,968 to Linder all discuss devices for the insertion of sheets into an envelope-type packet. Ward discusses a currency-holding packet and a method of forming the packet and inserting bills of currency into the packet using prior art envelope stuffers. Katz et al. discloses a system for producing a mass distributable packet wherein a web of paper is provided and cut to form sheets. The sheets are then accumulated and stacked in a hopper and the bottom sets are successively removed and packaged in a standard envelope inserter. Linder describes a device to insert printed products into an envelope using a rotating conveying member that is equipped with receiving pockets that are distributed over its circumference and can be closed and opened.

Finally, U.S. Pat. No. 4,295,643 to de la Vega; U.S. Pat. No. 5,823,320 to Seidel et al.; and U.S. Pat. No. 6,311,968 to Linder et al. all disclose devices for the transporting and inserting of flat products. Each of the references is directed to devices which may be used for the transportation of newspaper jackets and insertion of various supplemental materials therein.

As shown in the prior art, the use of machines for the stuffing of envelopes or other closed-end products is well known in the industry. However, these particular designs have not addressed the insertion of sheet articles into one or more folder pockets. Stuffing of folder pockets in the past has involved manually registering accumulated inserts, placing them in folder pockets, and folding the folder manually to produce the final product of a stuffed folder. The stuffed folder is then typically placed onto either a stack or conveyor where it is often re-checked for quality control purposes. Because this is a manual procedure, it is time consuming and subject to integrity errors, such as missing an insert or mixing the order. In addition, because of the number of repetitive motions involved, hand-stuffing folders can cause health problems.

In light of the above, there exists a need therefore for an automated folder stuffing apparatus and method that overcomes the above described shortcomings.

DISCLOSURE OF THE INVENTION

An automated folder stuffing apparatus and method is provided for stuffing a folder of the type that is foldable along a fold line and includes an inside surface and at least one pocket formed on the inside surface. The folder stuffing apparatus includes a conveyor for advancing a folder along a conveying surface of the conveyor, an opener for at least partially opening a pocket of the folder, and an inserter for inserting insert material into the folder pocket while the pocket is open. The conveyor surface can further include a plurality of vacuum ports and the conveyor can further include a rotatable endless member and a pusher element for engaging and advancing the folder along the conveyor surface. The inserter can further include an insert carriage member slidable along an insert track for releasably engaging the insert material and directing the insert material into the opened pocket. Readers can be included and utilized at various positions for reading data code, which can be on the insert material and even the folders, and the data read can be used to process items in a predetermined manner.

A method for stuffing insert material into a pocket of a folder includes advancing a folder along a conveyor surface while an outside surface of the folder slidably contacts the conveyor surface and a pocket of the folder faces outwardly in relation to the conveyor surface. The method further includes at least partially opening the folder pocket with an opener when the folder has reached an insertion site of the conveyor surface and inserting insert material into the folder pocket while the folder is at the insertion point. The insert material and even the folders can include data codes thereon which can be used for controlling various steps of processing as desired to ensure the integrity of assembled stuffed folders.

It is therefore an object to provide a novel automated folder stuffing apparatus and method for stuffing a folder having at least one pocket.

An object having been stated hereinabove, and which is achieved in whole or in part by the folder stuffing apparatus and method described herein, other objects will become evident as the description proceeds when taken in connection with the accompanying drawings as best described hereinbelow.

BRIEF DESCRIPTION OF THE DRAWINGS

Exemplary embodiments of the invention will now be explained with reference to the accompanying drawings, of which.

DETAILED DESCRIPTION OF THE INVENTION

Figure 1:
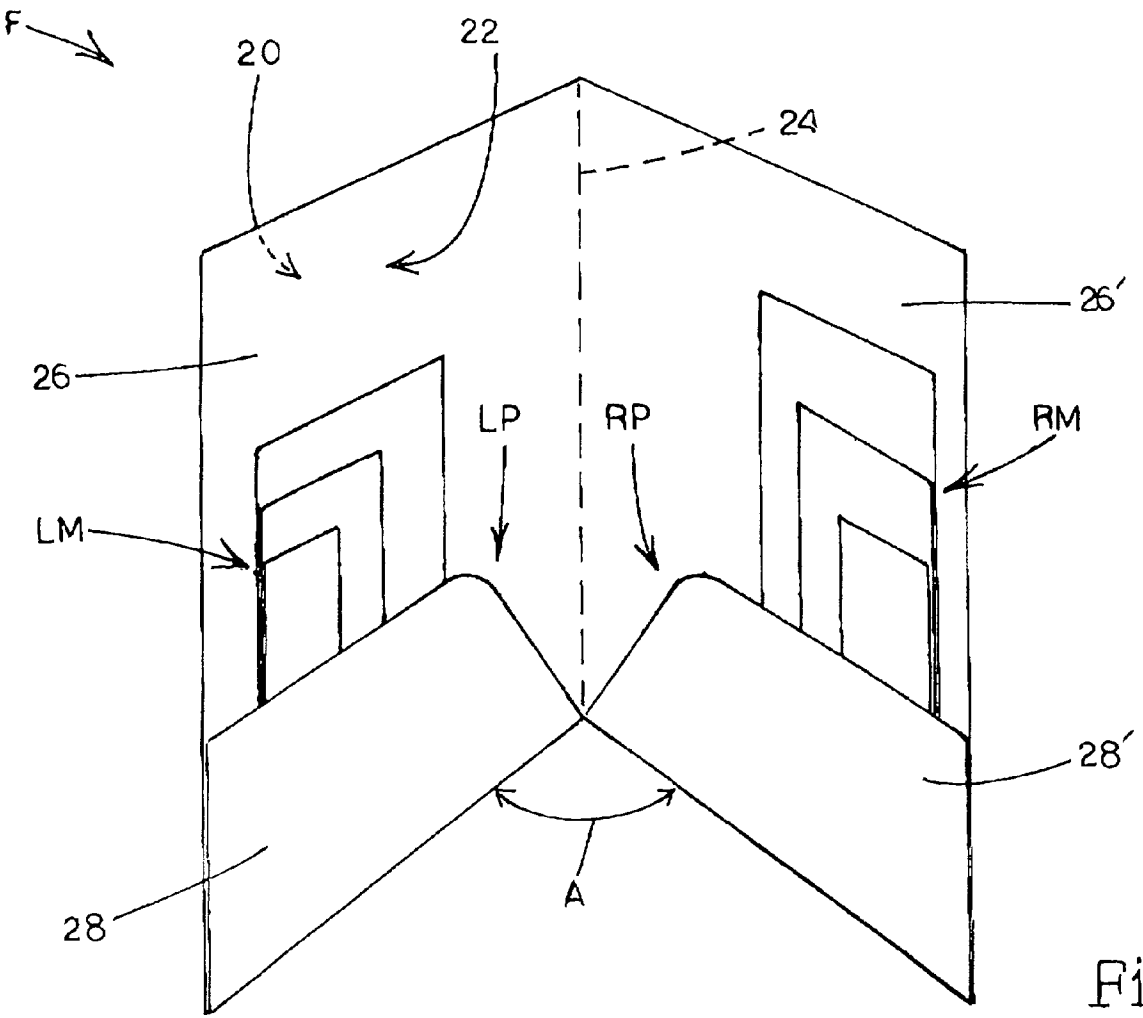
FIG. 1 is a perspective view of a folder with two pockets stuffed with insert material.

Referring now to FIG. 1, a sample folder F that can be stuffed by the apparatus and method described herein is shown. Folder F includes an outside surface generally designated 20, an inside surface generally designated 22, and a fold line 24 that runs down the middle of folder F, preferably separating both sides equally. The left side of folder F has a left inside panel 26 and a left flap 28, wherein the void defined between left inside panel 26 and left flap 28 is the left pocket generally designated LP. Similarly, the right side of folder F has a right inside panel 26' and a right flap 28', wherein the void defined between right inside panel 26' and right flap 28' is the right pocket, generally designated RP. Collated insert material, such as, for example, left pocket insert material generally designated LM, and right pocket insert material generally designated RM, can be inserted into the appropriate pockets LP, RP of folder F as described further below. Folder F can be considered to be in a folded state when an angle A between left and right inside panels 26, 26' is less than 180 degrees, and can be considered to be in an open state when angle A is greater than 180 degrees.

Figure 2:
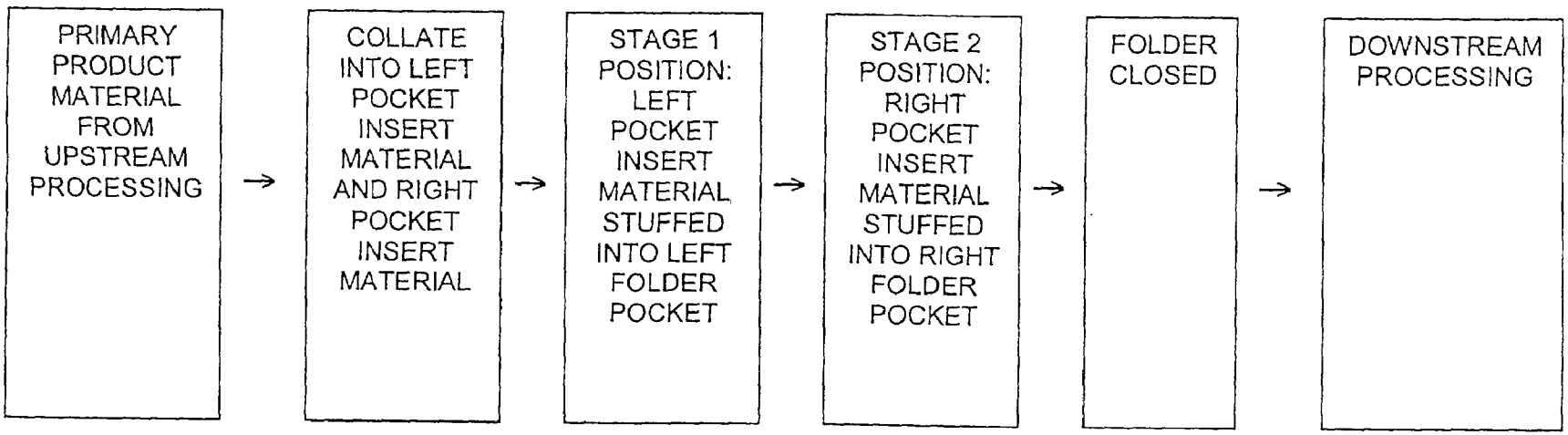
FIG. 2 is a flow diagram illustrating an embodiment of the folder stuffing method.

Referring now to FIG. 2, an overview of a preferred embodiment of the automated folder stuffing method is illustrated. A folder, such as folder F, of any suitable type with one or more pockets LP, RP can be automatically stuffed with accumulated pocket insert materials LM, RM, folded, and conveyed to a final destination for distribution. Stuffing can occur downstream of a device that is capable of transporting pre-collated material, typically collated by other mechanical means, such as by using push pins located along a transport surface. Primary product material, such as sheets, pamphlets, booklets, etc., can be received generally along a material feed or flow direction from an upstream location into the folder stuffing apparatus. In a preferred embodiment, primary product material can be collated into left pocket insert material LM and right pocket insert material RM. Left pocket insert material LM and right pocket insert material RM can each constitute a different predetermined combination of primary product material (e.g., one or more individual sheets, a stapled set of sheets, cards, booklets, etc.) as desired by the user for stuffing left folder pocket LP or right folder pocket RP. Left pocket insert material LM and right pocket insert material RM can be conveyed in a manner in which they will alternate along the transport surface when moving towards the folder stuffing apparatus, such that left pocket insert material LM to be stuffed in left folder pocket LP will be followed by right pocket insert material RM to be stuffed in right folder pocket RP, and this series can repeat for sets 3 and 4, 5 and 6, etc. It is also envisioned that if a user desires to stuff only one pocket of folder F, such as, for example, right folder pocket RP, only right pocket insert material RM will be produced in a series for stuffing the right folder pocket RP.

Folder F to be stuffed can enter the folder stuffing apparatus by way of a separate conveyor that advances folder F along a conveying surface wherein folder F is in an open state. While running in parallel to the folder conveying system, left pocket insert material LM can enter a Stage 1 position where it can be mechanically stuffed into left folder pocket LP by a process to be described in more detail below. Right pocket insert material RM can pass through the Stage 1 position and enter a Stage 2 position where can be mechanically stuffed in a similar manner into right folder pocket RP. After folder pockets LP, RP are automatically stuffed with pocket insert materials LM, RM, respectively, and folder F is folded, the final product, a stuffed folder, can then be transferred to a downstream location generally along an exit or output direction.

Figure 3:
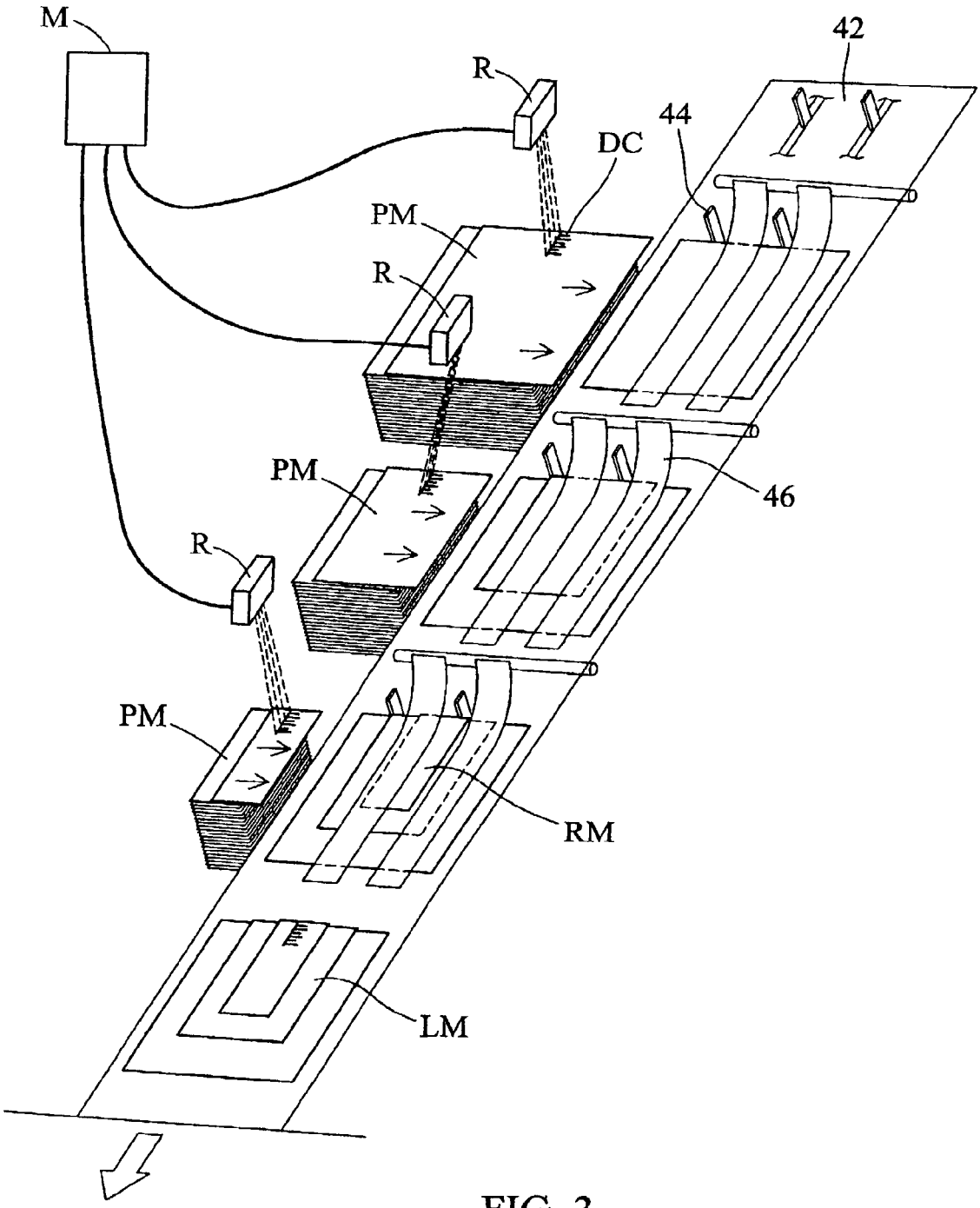
FIG. 3 is a partial isometric view of a feeding and conveying system for feeding insert material into the folder stuffing apparatus.

Referring to FIG. 3 where the detailed illustration of stuffing folders begins, production of a stuffed folder begins with the delivery of assembled insert material, such as from a stack or an advanced stream, from any conventional device for assembling or processing such documents. Non-limiting examples of such devices include devices or systems including feeders, cutters, readers, folders, stagers, and/or turnover devices. As illustrated in FIG. 3 in an exemplary embodiment, primary product material PM can comprise any documents suitable for assembly into a set of insert material and for stuffing into a folder as described above. As illustrated for exemplary purposes, primary product material PM comprises individual stacks of insert materials which can be fed from the side (preferably bound edge first and printed side face up for booklets, stapled sets of sheets, etc.) onto insert transport surface 42 to form assembled sets of materials, which can be left pocket insert material LM and right pocket insert material RM.

As can be appreciated by those of skill in the art, one or more pieces of primary product material PM can include data code DC thereon, shown in FIG. 3 as bar codes. Data code DC can be positioned in any suitable location on primary product material PM and can include any suitable readable data for feeding or processing instructions or for matching with one or more folder F. Readers R can be used to read data code DC from primary product material PM at any point during processing, such as prior to advancement onto insert transport surface 42, while being advanced onto insert transport surface 42, or at any desirable stage of processing after advancement onto insert transport surface 42. For exemplary purposes only, reading is illustrated in FIG. 3 as occurring as primary product material PM is being advanced onto insert transport surface 42. Readers R communicate with a central or local microprocessor M for processing of read data code DC and for controlling the processing of primary product material PM. The read data from data code DC can be used for selectively feeding certain primary product material PM in a predetermined manner and facilitating accurate matching and stuffing of primary product material PM with folders such as folder F and for verifying the integrity of stuffed folders, as further described hereinbelow.

In a preferred embodiment of stuffing a two pocket folder F with a left folder pocket LP and a right folder pocket RP, left pocket insert material LM and right pocket insert material RM can be assembled in a staggered, alternating order one behind the other. The controlled in-feed of primary product material PM to form pocket insert materials LM, RM can be implemented by providing means for feeding primary product material PM in accordance with a repeatable (i.e., cyclical) profile. It is envisioned that this profile can be programmed to enable primary product material PM to be fed in a manner creating left pocket insert material LM and right pocket insert material RM or can be programmed to only enable primary product material PM to be fed in a manner creating one set of either left pocket insert material LM or right pocket insert material RM (such as, for example, if only the right pocket RP of folder F is to be stuffed). This profile can be suitably adjusted according to user specifications. Left pocket insert material LM and right pocket insert material RM can be accumulated and formed in alternate sets along insert transport surface 42 as they are directed toward the folder stuffing module.

It is preferable that all product material PM, whether individual sheets or multiple-sheet items such as stapled sheet sets or booklets, be fed onto insert transport surface 42 face up and in a left-to-right orientation. In the case of bound insert materials such as booklets and pamphlets, the left-to-right orientation means that product material PM is fed with its bound edge first, which is the orientation with which conventional inserter machines feed insert materials. As a result, the insert materials constituting each left pocket insert material LM and each right pocket insert material RM are all oriented in the same manner. As described hereinbelow, each left pocket insert material LM can be inserted into left folder pocket LP of folder F such that the bound edge enters left folder pocket LP first and the non-bound edge last. By contrast, each right pocket insert material RM can be inserted into right folder pocket RP of folder F such that the non-bound edge enters right folder pocket RP first and the bound edge last. As a result, both left pocket insert material LM and right pocket insert material RM are presented in folder F in the left-to-right orientation, thereby rendering left and right pocket insert materials LM and RM immediately and easily readable upon opening the stuffed folder F.

Assembled pocket insert materials LM, RM can be pushed along insert transport surface 42 by push pins 44 or any other suitable form of conveying system known to those skilled in the art. Insert transport surface 42 can be further indexed with the use of registration straps 46 to ensure rear registration against push pins 44 as primary product material PM is fed and formed into pocket insert materials LM, RM. Registration straps 46 can be constructed of metal, cloth, plastic or any other suitable material known to those skilled in the art. After all requisite primary product material PM has been fed and pocket insert materials LM, RM have been completely formed, pocket insert materials LM, RM can be pushed downstream for further processing.

Figure 4A:
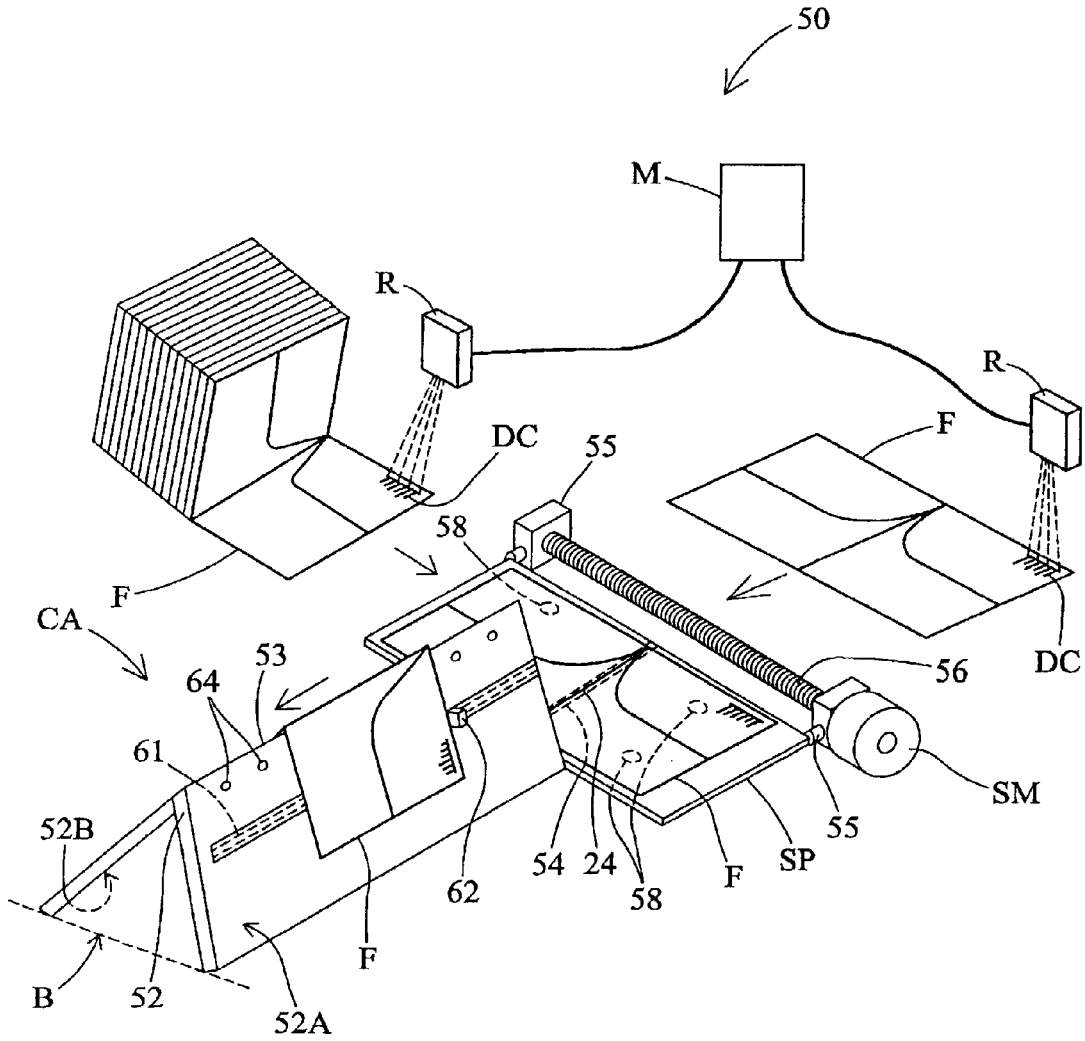
FIGS. 4A and 4B are isolated schematic isometric views of a folder feeding section of the folder stuffing apparatus.
Figure 4B:
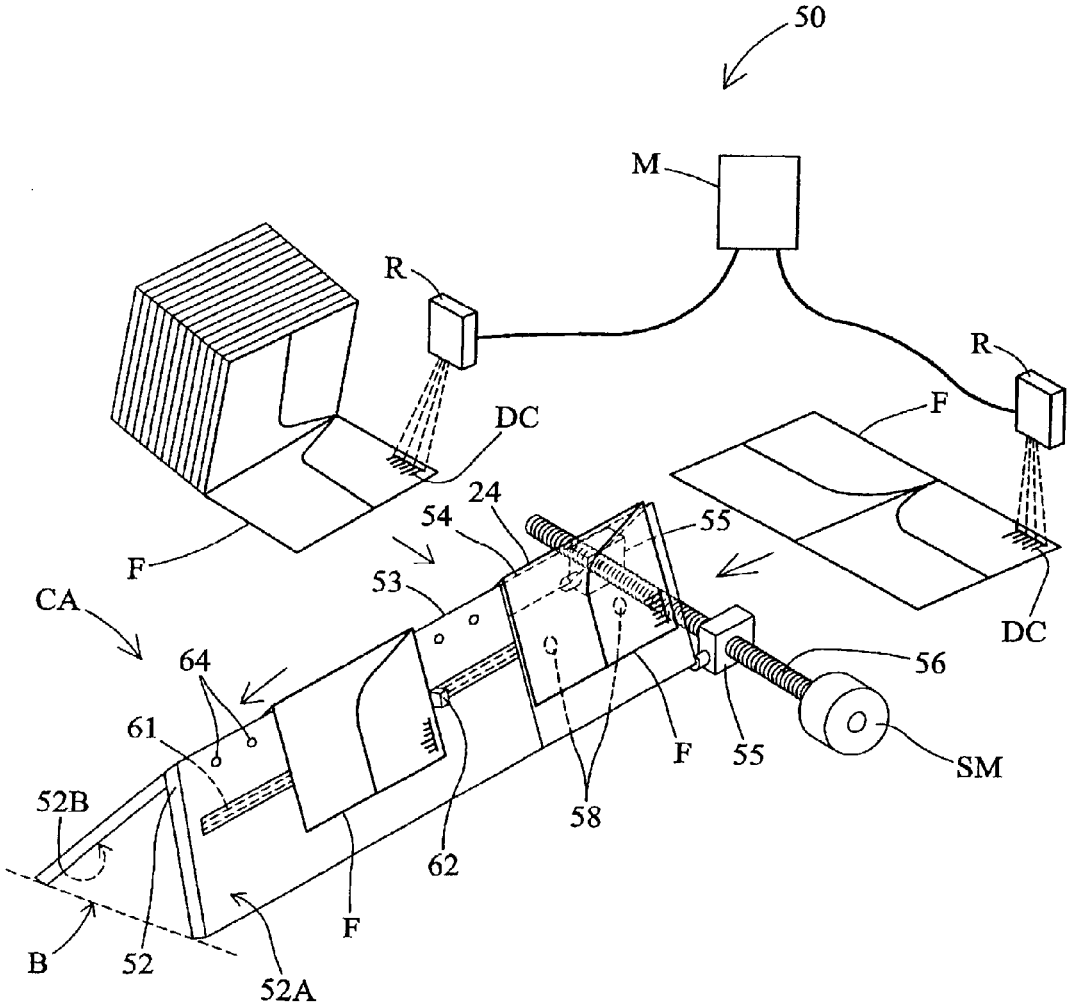

Referring now to FIGS. 4A and 4B, seriatim preparation of folders F is illustrated. Initially, folders F can be fed into a folder entry area generally designated 50 in an open position from any suitable direction. As illustrated for exemplary purposes, folders F can be provided from a direction that can be perpendicular or parallel to insert transport surface 42 (shown in FIG. 5) in order to ultimately be positioned on a folder conveyor assembly generally designated CA. As described above with reference to primary product material PM, folders F can include data code DC thereon, illustrated as bar code, which can include any suitable data for feeding or processing instructions or for matching folders F with certain, predetermined primary product material PM, such as for example assembled left pocket insert material LM and right pocket insert material RM. One or more readers R can be used to read data code DC from folders F at folder entry area 50. Readers R can communicate with a central or local microprocessor M for processing of read data code DC and for controlling the processing of folders F. The data from each data code DC can be utilized in any suitable manner to identify and recognize folders F and to process them in a predetermined and controlled fashion. Desired folders F can be matched up with desired primary product material PM, such as left pocket insert material LM and/or right pocket insert material RM. Accurate stuffing and verification of the integrity of folders F can thus be accomplished. The processing of read data code from both folders F and primary product material PM enables automated stuffing of folders F wherein selected, predetermined folders F can be stuffed on demand and in a personalized manner with only selected, predetermined primary product material PM. Data code DC on primary pocket material PM and folders F can further be processed and used to determine what to do to certain folders F. For example, instructions can be provided to selectively print or paint certain items on selected folders F, or instructions can be provided as to whether or not to stuff certain folders F at all as advanced pocket insert material and/or folders F can be selectively advanced without being stuffed as described further below with reference to FIG. 5.

In a preferred embodiment, folder conveyor assembly CA is configured as an A-frame structure 52 having a first conveyor surface generally designated 52A and a second conveyor surface generally designated 52B wherein first and second conveyor surfaces 52A, 52B are joined at a common edge 53 and extend outwardly at an angle from common edge 53 relative to a base plane generally designated B. Conveyor assembly CA further comprises a conveyor consisting of, for example, an endless member 61 such as a chain or belt with pusher elements 62 such as grips or fingers, or any other conveying mechanism known to those skilled in the art.

In a preferred embodiment, folder F can enter folder entry area 50 and come to rest in a substantially flat position on a swivel plate SP, as shown in FIGS. 4A and 4B. Swivel plate SP is an invertible section comprising a central hinge 54 that allows swivel plate SP to pivot upwardly in the center. Swivel plate SP is further attached by appropriate linkages 55 to a rod-type linear actuator 56, such as a ball screw that provides linear motion via a motor SM. Swivel plate SP can also comprise one or more vacuum ports 58 through which a vacuum can be applied as can be appreciated by those of skill in the art to suitably hold folder F to swivel plate SP during the upward motion of swivel plate SP.

Once folder F has entered folder entry area 50 and has come to rest on swivel plate SP, a vacuum is applied through vacuum ports 58 to secure folder F. Motor SM is then activated, thus turning linear actuator 56 drawing linkages 55 on both ends of swivel plate SP towards one another, thus urging swivel plate SP upwardly at central hinge 54, as shown in FIG. 4B. Folder F, maintained in position on swivel plate SP, will also be drawn upwardly at folder fold line 24 thus drawing folder F from a substantially flat position to an inverted position with folder inside surface 22 facing outwardly and left and right folder inside panels 26, 26' substantially coplanar with first and second conveyor surfaces 52A, 52B.

Once opened and suitably partially inverted, folder F can be conveyed onto A-frame 52 and moved downstream towards a Stage 1 position 70 (shown in FIG. 5) via endless member 61 and pusher elements 62. Folder F can be advanced along A-frame 52 for further processing while folder F maintains an inverted state wherein folder inside surface 22 and folder left and right pockets LP, RP face outwardly in relation to first and second conveyor surfaces 52A, 52B.

Figure 5:
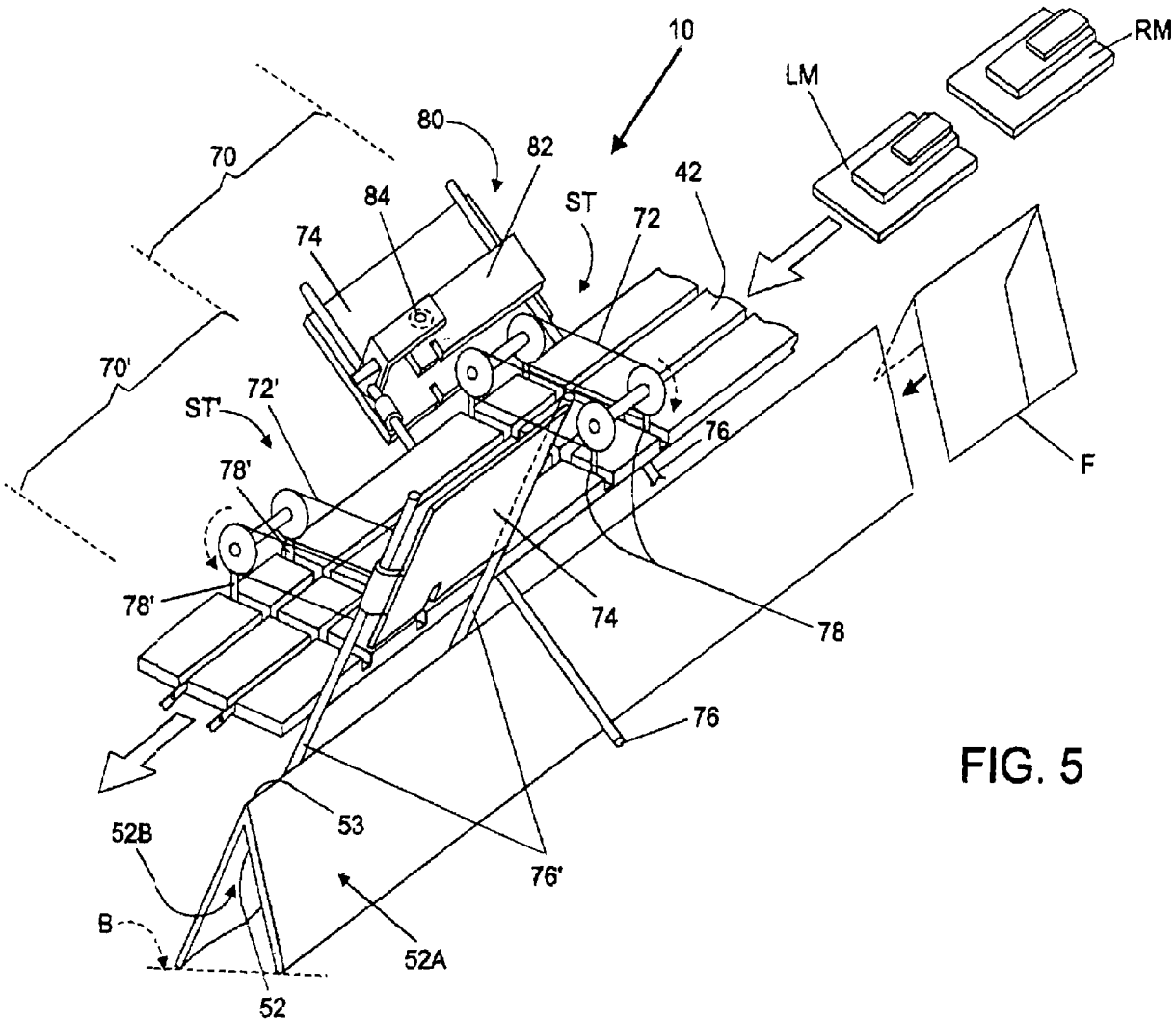
FIG. 5 is a partial schematic view of an embodiment of the folder stuffing apparatus.
Figure 6:
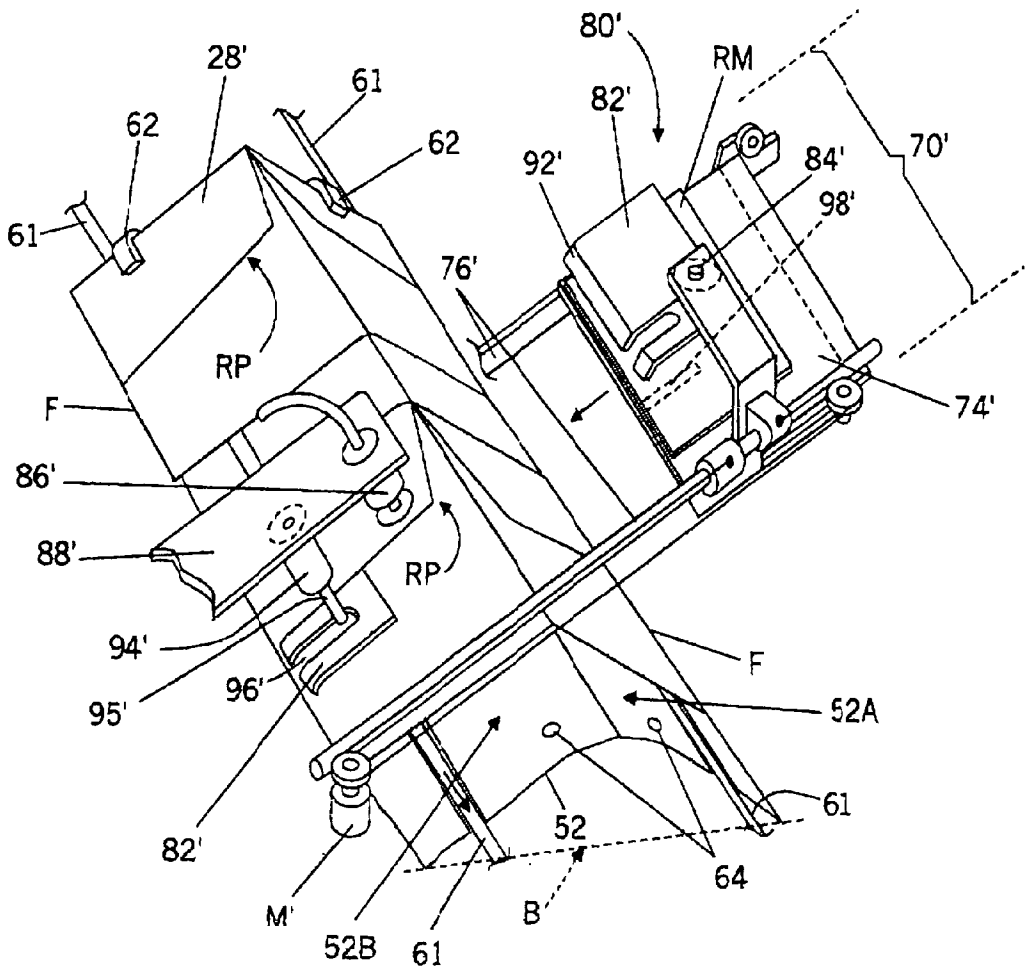
FIG. 6 is a partial isometric view of a folder stuffing stage.
Figure 7:
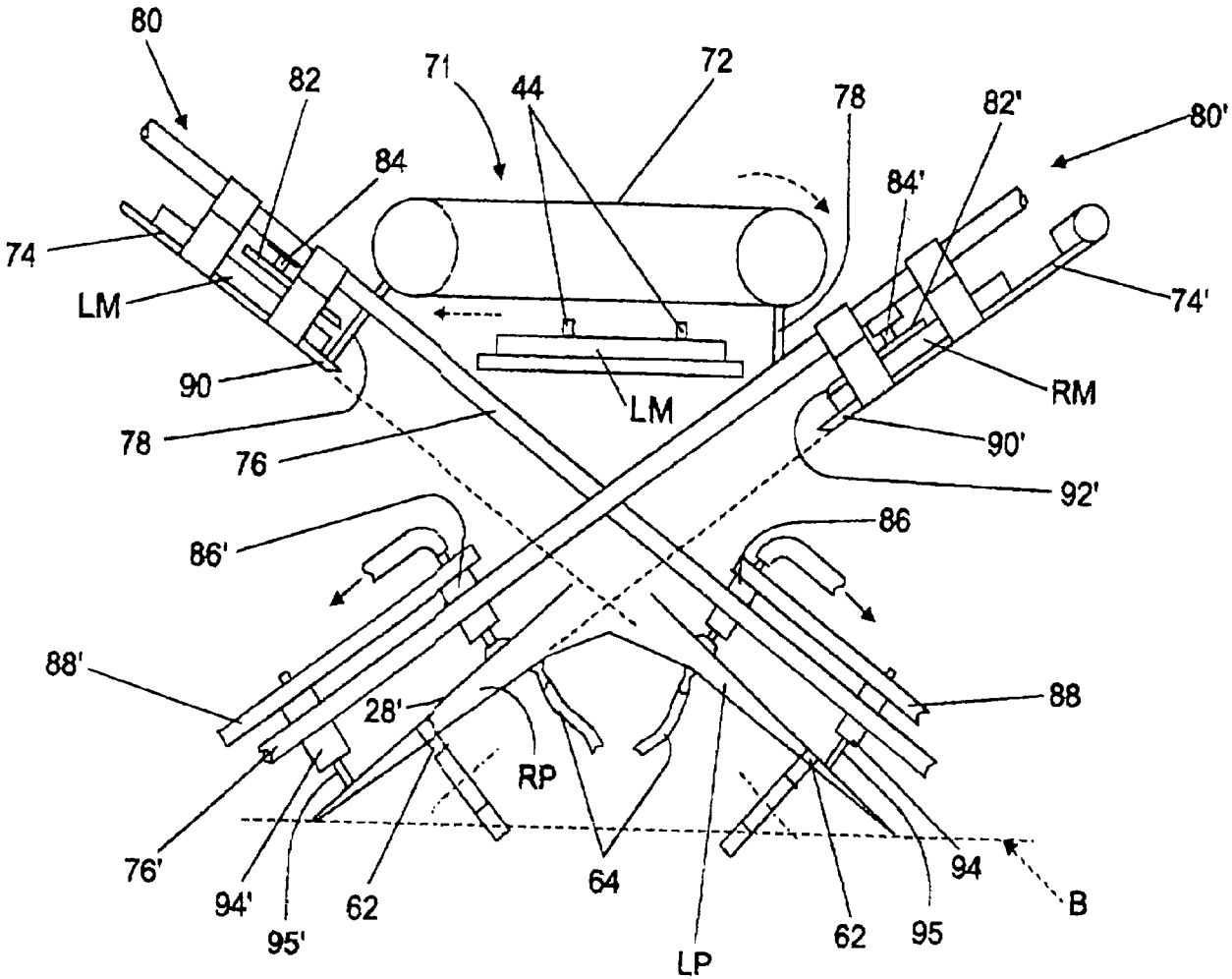
FIG. 7 is a front-end view of an embodiment of the folder stuffing apparatus.

Referring now to FIGS. 5–7, folder stuffing stages of a preferred embodiment of folder stuffing apparatus 10 are described. Two folder stuffing stages include a Stage 1 position 70, where left folder pocket LP can be stuffed and a Stage 2 position 70', where right folder pocket RP can be stuffed. As shown in FIG. 5, left pocket insert material LM and right pocket insert material RM that are to be stuffed into left folder pocket LP and right folder pocket RP, respectively, can be located above folder F that is carried along A-frame 52.

Insert material for entering folder stuffing stages 70, 70' can be read or otherwise recognized as consisting of left pocket insert material LM or right pocket insert material RM. If the insert material is left pocket insert material LM, it will be processed in Stage 1 position area 70 for stuffing into left folder pocket LP; similarly, if the insert material is right pocket insert material RM, it will pass through Stage 1 position 70 and move further downstream to be processed in Stage 2 position area 70' for stuffing into right folder pocket RP. As discussed earlier, if a user desires that only one pocket of a two pocket folder F be filled (or if the user is stuffing a one pocket folder F), the stage position that is not being used to fill a folder pocket can be intentionally by-passed. For example, if a user desires to fill only right folder pocket RP of a two pocket folder F, Stage 1 position 70 that normally stuffs left folder pocket LP can be by-passed such that Stage 2 position 70' to fill right folder pocket RP will only be activated and vice-versa. Each of the two folder stuffing stages 70, 70' described above can operate in a similar manner as will now be described in further detail below.

When the particular pocket insert materials LM, RM enter the appropriate folder stuffing stage (i.e., Stage 1 position 70 for left pocket insert material LM and Stage 2 position 70' for right pocket insert material RM), side transporters generally designated ST, ST' can be activated. In a preferred embodiment, side transporters ST, ST', respectively, comprise endless belt systems 72, 72' with push pins 78, 78' or any other suitable conveying system as known to those skilled in the art and can be oriented transversely to insert transport surface 42. Side transporters ST, ST' can activate to transfer applicable pocket insert materials LM, RM from insert transport surface 42 to insert carriage members generally designated 80, 80'.

Insert carriage members 80, 80' can be slidably attached to insert track or guide rails 76, 76' such that insert carriage members 80, 80' and all associated mechanisms can move up and down guide rails 76, 76' as necessary, driven by motors M, M' (see FIG. 6). As shown in FIGS. 6 and 7, in a preferred embodiment, guide rails 76, 76' are configured so that insert carriage members 80, 80' are slidable along guide rails 76, 76' through an insert path that is substantially coplanar with first and second conveyor surfaces 52A, 52B, respectively.

Figure 8:
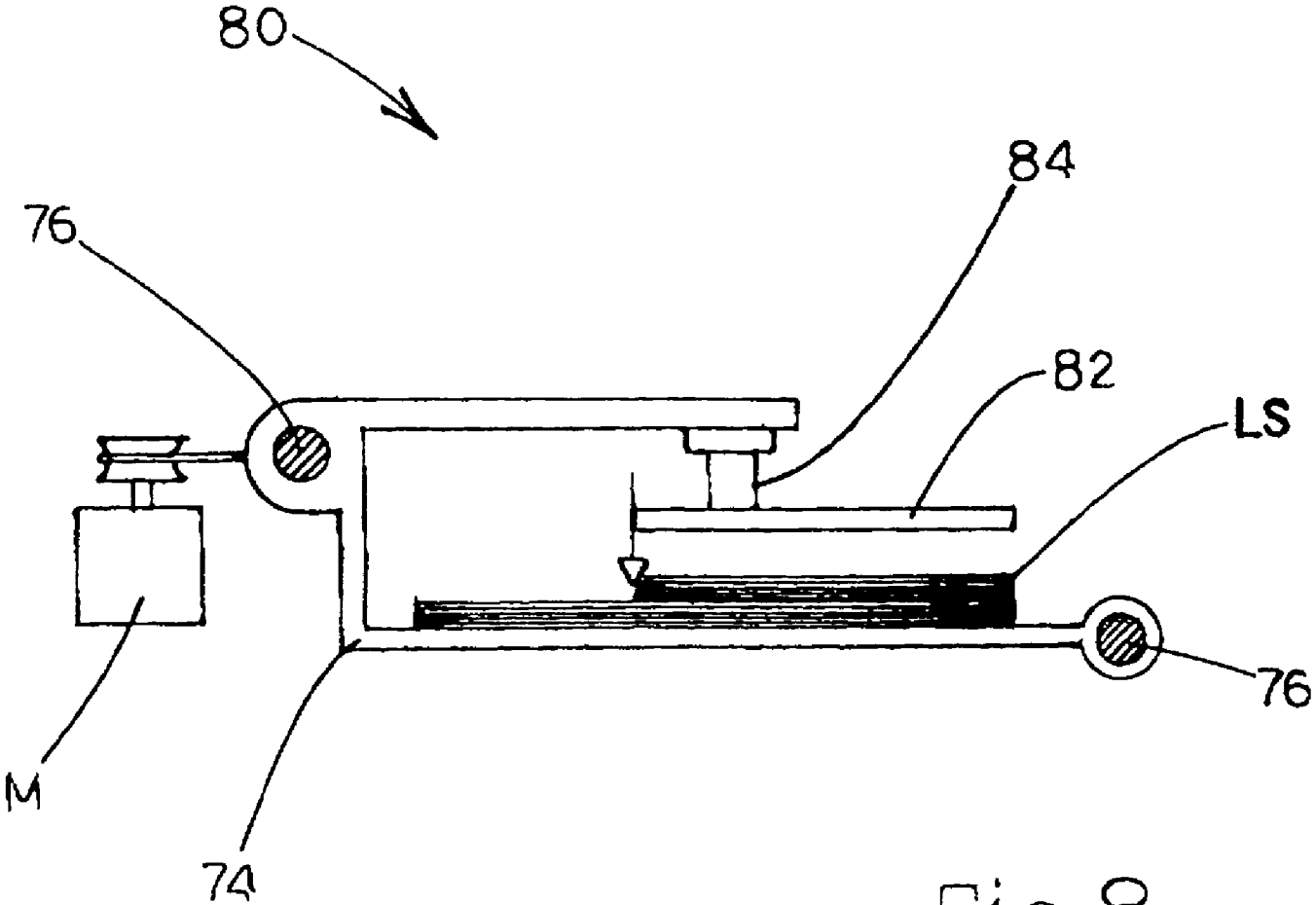
FIG. 8 is a side view of a clamping unit that can be used with the folder stuffing apparatus.

Insert carriage member 80, used in Stage 1 position 70, is shown in FIGS. 7 and 8, with an isolated view illustrated in FIG. 8. Insert carriage member 80' (shown in FIGS. 6 and 7) used in Stage 2 position 70' can be similarly configured. Insert carriage members 80, 80' can comprise clamp plates 82, 82' that are attached to registration platters 74, 74' by clamp plate solenoids 84, 84'. Clamp plate solenoids 84, 84' allow clamp plates 82, 82' to be raised and lowered onto pocket insert materials LM, RM, thus catching pocket insert materials LM, RM in a secured manner between clamp plates 82, 82' and registration platters 74, 74', respectively. Registration platters 74, 74', clamp plates 82, 82', and clamp plate solenoids 84, 84', respectively, together form the insert carriage members 80, 80' which hold pocket insert materials LM, RM, respectively, and subsequently place pocket insert materials LM, RM into the applicable folder pockets LP, RP, respectively. It thus can be seen that insert carriage members 80, 80' can operate as staging devices to hold pocket insert materials LM, RM as necessary for a predetermined or programmed period of time. The ability to stage pocket insert materials LM, RM in this manner facilitates the synchronization of the operation of insert carriage members 80, 80' with other operative components of folder stuffing apparatus 10, such as pocket opening vacuum solenoids 86, 86' described hereinbelow.

As shown in FIG. 7, push pins 78, 78' that are attached to the drive belts of endless belt systems 72, 72' can contact the applicable pocket insert materials LM, RM and transfer them in a transverse direction off of insert transport surface 42 and onto registration platters 74, 74' of insert carriage members 80, 80'. Push pins 78, 78' will push pocket insert materials LM, RM to a predetermined position on registration platters 74, 74' and will then stop movement, thus holding pocket insert materials LM, RM in position. Push pins 78, 78' can produce a jogging movement to register pocket insert materials LM, RM such that their contents are rear end and edge registered for placement into the applicable pockets LP, RP of folder F.

Referring back to FIGS. 5–7, once push pins 78, 78' have moved pocket insert material LM, RM into position and have edge registered the inserts by jogging, clamp plates 82, 82' can be lowered on pocket insert material LM, RM, thus securing pocket insert material LM, RM between clamp plates 82, 82' and registration platters 74, 74' of insert carriage members 80, 80' for subsequent placement into applicable folder pockets LP, RP, respectively, guided by insert carriage members 80, 80', respectively.

With pocket insert materials LM, RM secured to insert carriage members 80, 80', respectively, and waiting or staged for insertion by insert carriage members 80, 80', respectively, folder F is pushed along A-frame 52 into position for stuffing, with gripper finger pushers 62 pushing folder F from the rear or by another suitable conveying system. Additional holding support on first and second conveyor surfaces 52A, 52B for folder F can be provided by suitable vacuum through vacuum ports 64 or similar mechanisms embedded in A-frame 52 that subjects outside surface 20 of folder F to a vacuum, thus securing folder F to A-frame 52.

Once folder F is in position between guide rails 76, 76', pocket openers such as pocket opening vacuum solenoids 86, 86' as illustrated in FIG. 6, or other suitable opening mechanisms, can be used to open left folder pocket LP or right folder pocket RP, as applicable (FIG. 6 illustrates the process in Stage 2 position 70' of stuffing right folder pocket RP). Pocket opening vacuum solenoids 86, 86' can be rigidly attached to anchor plates 88, 88' that are rigidly attached to the apparatus frame (not shown). As shown in FIG. 7, pocket opening vacuum solenoids 86, 86' are lowered onto and engage folder flaps 28, 28', respectively. With A-frame vacuum ports 64 providing suction on folder outside surface 20 (shown in FIG. 1), pocket opening vacuum solenoids 86, 86' are raised back towards their initial positions, thus raising folder flaps 28, 28' and opening folder pockets LP, RP.

With folder pockets LP, RP in an open position, pocket insert materials LM, RM (as applicable) secured by insert carriage members 80, 80' (including registration platters 74, 74', clamp plates 82, 82', and clamp plate solenoids 84, 84') can then move downwardly on guide rails 76, 76' by motors M, M' to move pocket insert materials LM, RM into folder pockets LP, RP, all respectively. The leading edges of pocket insert materials LM, RM are protected on top by clamp plates 82, 82' and on the bottom by registration platters 74, 74' so that pocket insert materials LM, RM will not catch on any seams on flaps 28, 28' or inside panels 26, 26' on the inside of folder pockets LP, RP. Leading edges 90, 90' of registration platters 74, 74' and leading edges 92, 92' of clamp plates 82, 82' are beveled or otherwise machined (see FIG. 7) so as to not catch on any seams on the inside of folder pockets LP, RP, all respectively.

Referring to FIGS. 6 and 7, once insert carriage members 80, 80' with pocket insert materials LM, RM have come to a position fully inside folder pockets LP, RP, insert hold-down devices, such as insert hold-down solenoids 94, 94' with corresponding reciprocable retainer rods 95, 95' can be activated. Insert hold-down solenoids 94, 94' can be rigidly attached to anchor plates 88, 88' and when activated, insert hold-down solenoids 94, 94' actuate retainer rods 95, 95' to move downwardly to apply pressure to pocket insert materials LM, RM through clamp plate slots 96, 96' formed in clamp plates 82, 82' and registration platter slots 98, 98' formed in registration platters 74, 74', all respectively. Insert hold-down solenoids 94, 94' can be located such that retainer rods 95, 95' will not contact folder pockets LP, RP but will only contact pocket insert materials LM, RM once the insert material is placed into applicable folder pockets LP or RP. Insert hold-down solenoids 94, 94' through retainer rods 95, 95' will hold pocket insert materials LM, RM against inside folder panels 26, 26' as they pass through clamp plate slots 96, 96' and registration platter slots 98, 98', all respectively.

With insert hold-down solenoid retainer rods 95, 95' applying pressure to pocket insert materials LM, RM, clamp plate solenoids 84, 84' will raise clamp plates 82, 82', thus retracting clamp plates 82, 82' off of pocket insert materials LM, RM, respectively, and back to their initial positions. Insert carriage members 80, 80' will then retract upwardly along guide rails 76, 76' through motors M, M', respectively. Insert hold-down solenoid retainer rods 95, 95' and pocket opening solenoids 86, 86', respectively, will then retract to their initial positions, and the folder stuffing cycle is complete.

As can be appreciated, if the folder stuffing cycle described above occurred in Stage 1 position 70 (stuffing of left folder pocket LP), folder F can then be advanced to Stage 2 position 70' along A-frame 52 if right folder pocket RP is to be stuffed. Right pocket insert material RM for right pocket RP will be advanced to Stage 2 position 70' and the above process can be repeated for stuffing right pocket RP. Concurrently, Stage 1 position 70 can then be filled with the next left pocket insert material LM and the next folder F follows just behind the one having its right pocket RP stuffed.

Referring again to FIG. 5, insert transport surface 42 can communicate with or be extended to a downstream path represented by arrow DP directed to any structure, module, or equipment situated downstream from the folder stuffing components described herein. The realization of downstream path DP in connection with the use of one or more readers R as described previously enables any pocket insert material LM or RM to be selectively rejected for stuffing into a folder pocket so that it is advanced in the direction of arrow DP for diverting out of the system entirely of for further processing as desired. For example, if any pocket insert material LM or RM was not compiled correctly or otherwise fails a verification or integrity test, it can be rejected for stuffing and the rejected material can be transported over insert transport surface 42 and through downstream path DP for diversion of further processing. Such further processing can even include recovering and rerouting the rejected insert material back to the collating area for again processing it through the folder stuffing components.

Figure 9A:
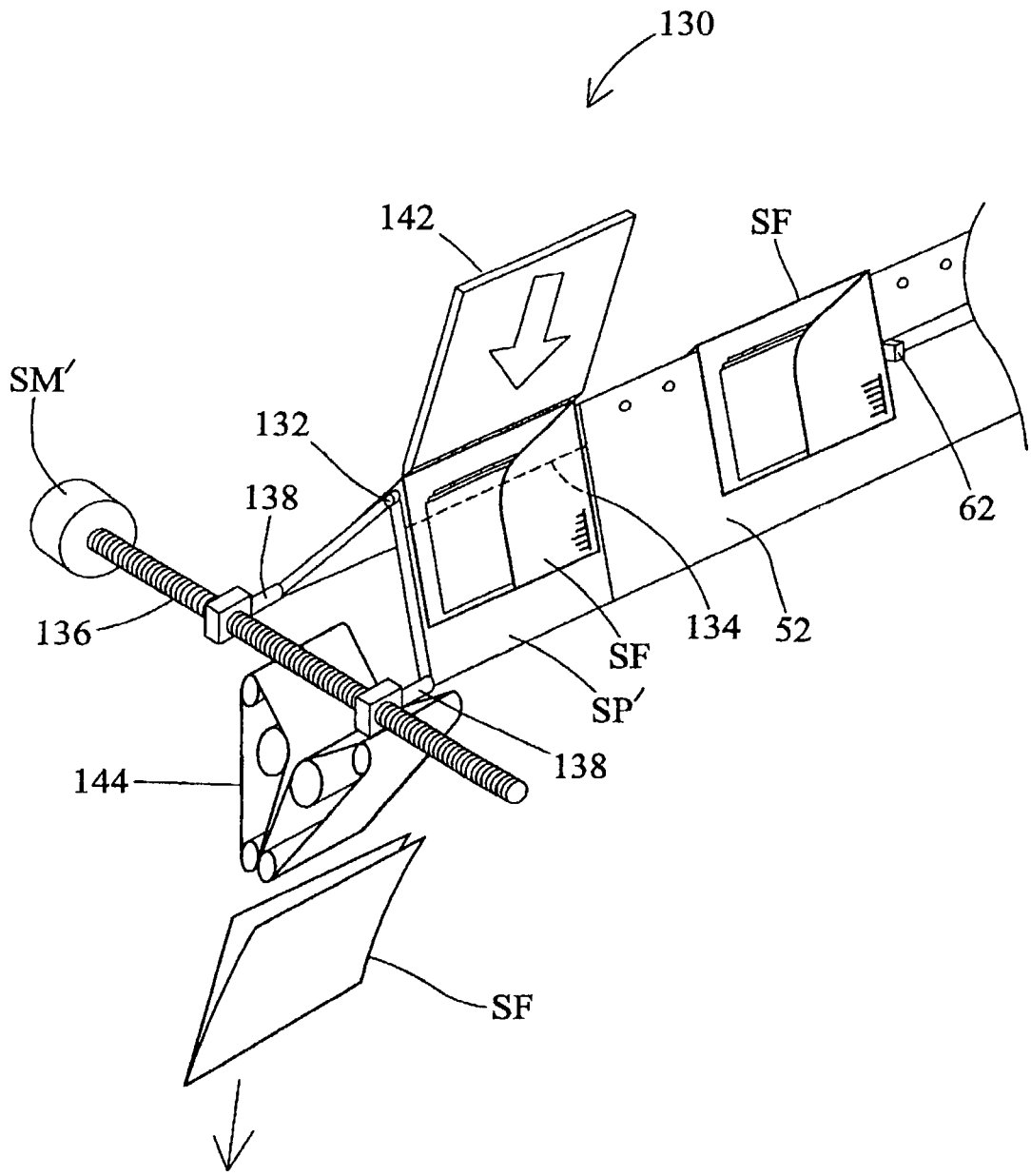
FIGS. 9A–9C are isolated schematic isometric views illustrating use of a folder folding section of the folder stuffing apparatus.
Figure 9B:
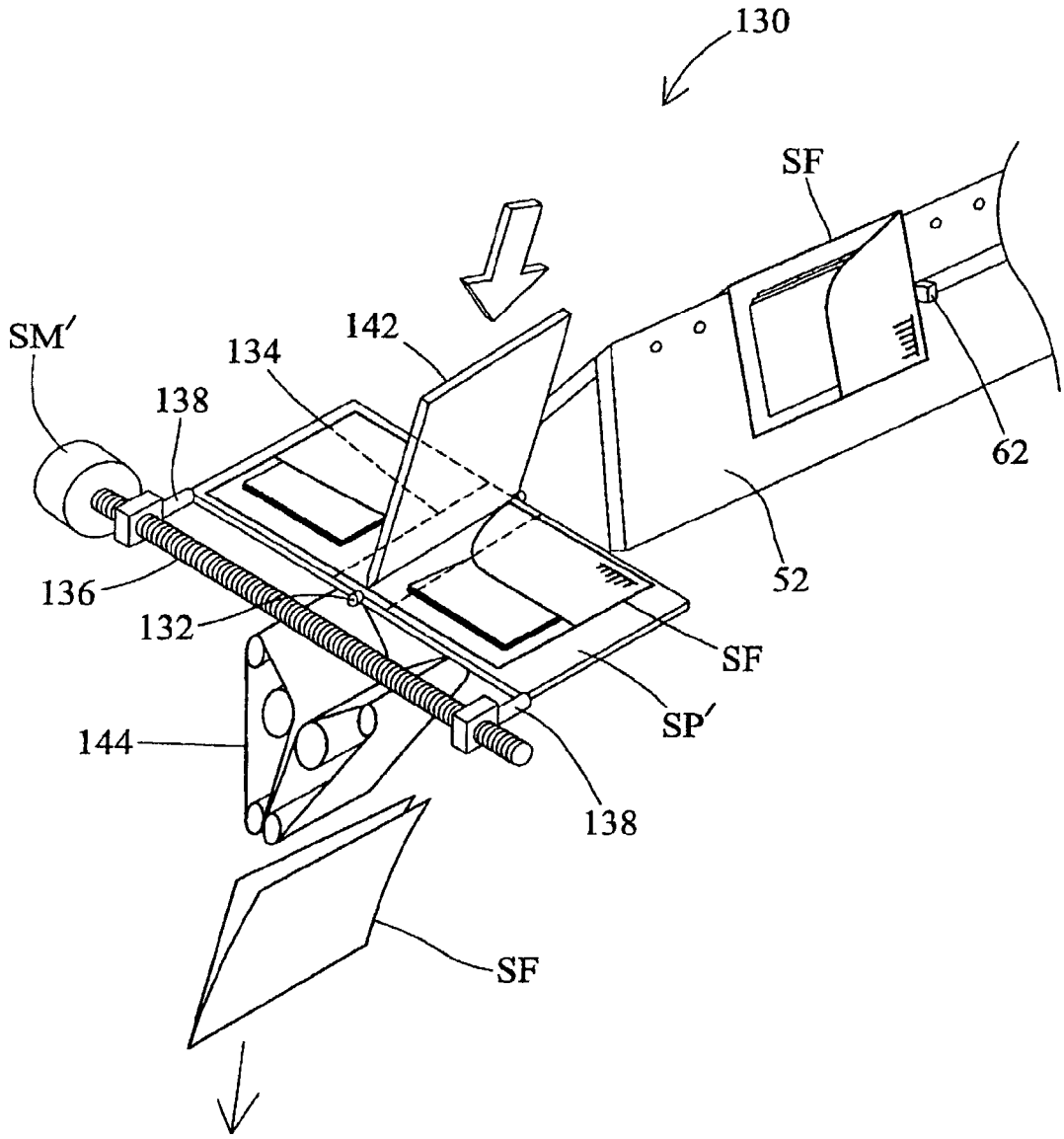
Figure 9C:
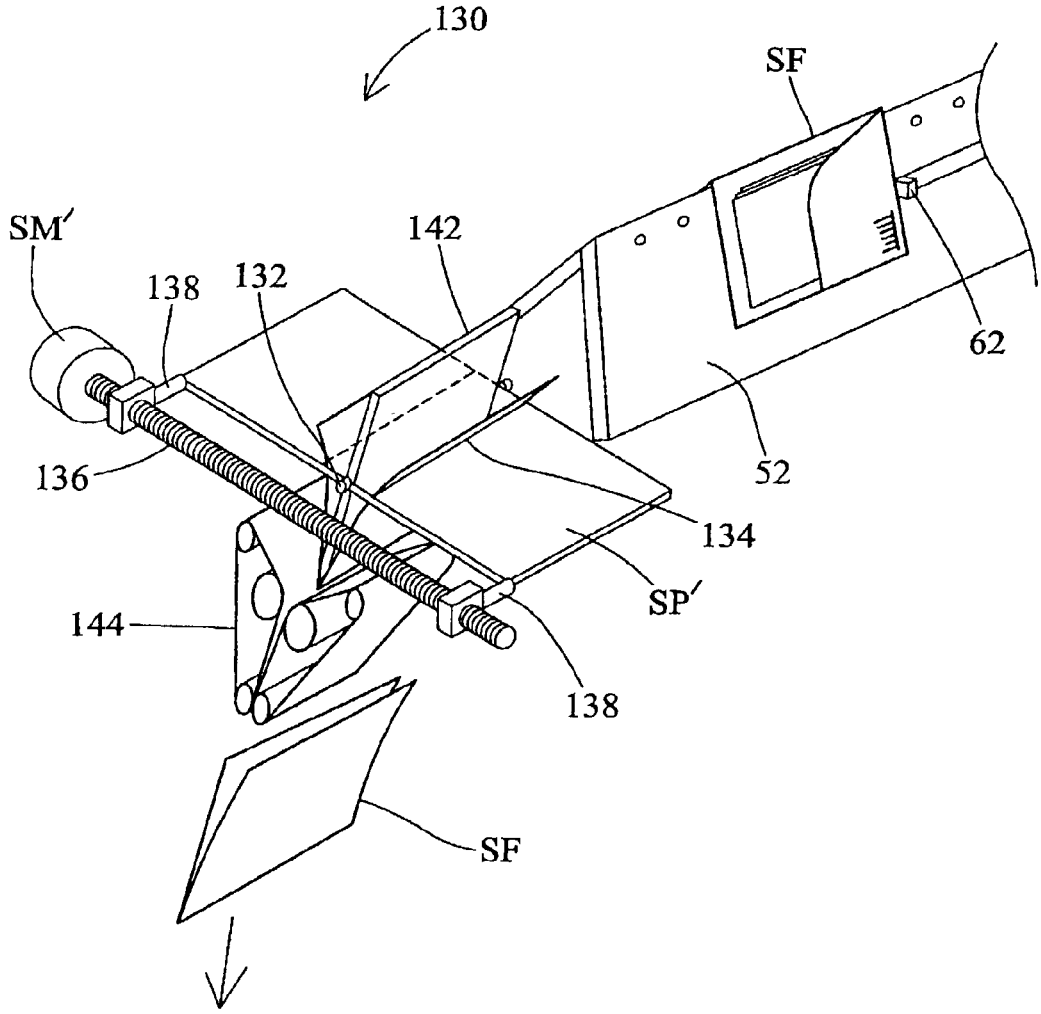

Referring now to FIGS. 9A–9C, in a preferred embodiment, once folder F is stuffed with applicable pocket insert materials LM, RM, the completed stuffed folder SF can be advanced into a folder folding section generally designated 130 and onto an exit swivel plate SP' (shown in an up position in FIG. 9A). Exit swivel plate SP' comprises a central hinge 132 that allows swivel plate SP' to pivot downwardly in the center. Exit swivel plate SP' further comprises a central slot or opening 134 that allows stuffed folder SF to pass downwardly through the center. Central hinge 132 will be placed on either side of central slot 134. Swivel plate SP' can be attached by appropriate linkage 138 to a rod-type linear actuator 136, such as a ball screw that provides linear motion via a motor SM'.

Referring to FIG. 9A, once stuffed folder SF is advanced onto swivel plate SP', a folding member or knife bar 142 of any suitable type can move downwardly into the center of stuffed folder SF, which helps keep pocket insert materials LM, RM from getting caught in fold line 24 (see FIG. 1). Once knife bar 142 comes into contact with stuffed folder SF, motor SM' is activated and linear actuator 136 turns, drawing swivel plate SP' downwardly at central hinge 132 to a flat position as shown in FIG. 9B. As illustrated in FIG. 9C, knife bar 142 "breaks" fold line 24 in stuffed folder SF downward through central slot 134 until stuffed folder SF is closed and exits through swivel plate SP'.

Once stuffed folder SF exits the system, belt transports 144 or similar mechanism can deliver stuffed folder SF to any form of downstream processing device. Non-limiting examples of downstream processing devices include conveyor, reading station, box, modular stuffer, poly wrapper, or any other form of processing unit.

It will be understood that various details of the invention may be changed without departing from the scope of the invention. Furthermore, the foregoing description is for the purpose of illustration only, and not for the purpose of limitation—the invention being defined by the claims.

What is claimed is:

1. An automated folder stuffing apparatus for stuffing an open folder of a type comprising an outside surface, first and second inside panels joined at a fold line and foldable toward each other at the fold line, and a pocket formed on at least one of the inside panels, the apparatus comprising:

(a) a conveyor for advancing the open folder and having first and second surfaces disposed on opposite sides of a longitudinal axis, the conveyor adapted for advancing the folder wherein the first and second inside panels of the folder are disposed on opposite sides of the longitudinal axis and wherein the pocket can be exposed in a non-horizontal position on one of the first and second surfaces of the conveyor during insertion of insert material;

(b) an opener for at least partially opening the exposed pocket of the folder; and (c) an inserter for inserting the insert material in a non-horizontal direction into the pocket while the pocket is open.

2. The folder stuffing apparatus according to claim 1 wherein the pocket comprises a flap and wherein the opener is adapted for opening the flap.

3. The folder stuffing apparatus according to claim 1 wherein at least one of the first and second surfaces of the conveyor comprises a plurality of vacuum ports for subjecting the outside surface of the folder to a vacuum.

4. The folder stuffing apparatus according to claim 1 wherein the conveyor comprises a rotatable endless member and a pusher element connected to the endless member and movable therewith for engaging and advancing the folder along the conveyor.

5. The folder stuffing apparatus according to claim 1 wherein the opener comprises a vacuum cup mounted above the conveyor and actuatable into contact with the pocket.

6. The folder stuffing apparatus according to claim 1 wherein the inserter comprises an insert carriage member slidable along an insert track for releasably engaging the insert material and directing the insert material into the opened pocket.

7. The folder stuffing apparatus according to claim 6 further comprising an insert hold-down device actuatable into engagement with the insert material while the insert material is in the pocket for retaining the insert material while the insert carriage member releases the insert material.

8. The folder stuffing apparatus according to claim 6 further comprising an insert transport surface disposed above the conveyor for transporting the insert material to the insert carriage member.

9. The folder stuffing apparatus according to claim 8 further comprising a side transporter for transferring the insert material from the insert transport surface to the insert carriage member.

10. The folder stuffing apparatus according to claim 6 wherein the first inside panel is disposed on a first side of the longitudinal axis and the second inside panel is disposed on a second side of the longitudinal axis, and further wherein the insert carriage member is slidable along the insert track from the first side of the longitudinal axis to the second side of the longitudinal axis.

11. The folder stuffing apparatus of claim 1 further comprising one or more readers for reading data code relating to feeding or processing instructions for matching or stuffing of the insert material into the folder.

12. An automated folder stuffing apparatus for stuffing a folder of a type comprising an outside surface, first and second inside panels joined at a fold line and foldable toward each other at the fold line, and a pocket formed on one of the inside panels, the apparatus comprising:

(a) a conveyor surface comprising first and second conveyor surface portions joined at a common edge and positioned at an angle to one another;

(b) a conveyor movable in relation to the conveyor surface for advancing the folder along the conveyor surface wherein the outside surface slidably contacts the first and second conveyor surface portions and the pocket faces outwardly in relation to at least one of the first and second conveyor surface portions;

(c) an opener for at least partially opening the pocket while the folder is on the conveyor surface; and (d) an inserter for inserting insert material into the pocket while the pocket is open.

13. The folder stuffing apparatus according to claim 12 wherein the first and second conveyor surface portions comprise a plurality of vacuum ports for subjecting the outside surface of the folder to a vacuum.

14. The folder stuffing apparatus according to claim 12 wherein the conveyor comprises a rotatable endless member and a pusher element connected to the endless member and movable therewith for engaging and advancing the folder along the conveyor surface.

15. The folder stuffing apparatus according to claim 12 wherein the opener comprises a vacuum cup mounted above the conveyor surface and actuatable into contact with the pocket.

16. The folder stuffing apparatus according to claim 12 wherein the inserter comprises an insert carriage member slidable along an insert track for releasably engaging the insert material and directing the insert material into the opened pocket.

17. The folder stuffing apparatus according to claim 16 wherein each of the first and second conveyor surface portions is oriented at an angle relative to a base plane and wherein the insert carriage member is slidable along the insert track through an insert path coplanar with one of the conveyor surface portions.

18. The folder stuffing apparatus according to claim 16 comprising an insert hold-down device actuatable into engagement with the insert material while the insert material is in the pocket for retaining the insert material while the insert carriage member releases the insert material.

19. The folder stuffing apparatus according to claim 16 comprising an insert transport surface disposed above the conveyor surface for transporting the insert material to the insert carriage member.

20. The folder stuffing apparatus according to claim 19 comprising a side transporter for transferring the insert material from the insert transport surface to the insert carriage member.

21. The folder stuffing apparatus according to claim 16 wherein the conveyor surface common edge defines a longitudinal axis where the first conveyor surface is on a first side of the longitudinal axis and the second conveyor surface is on a second side of the longitudinal axis, and further wherein the insert carriage member is slidable along the insert track from the first side of the longitudinal axis to the second side of the longitudinal axis.

22. An automated folder stuffing apparatus for stuffing a folder of a type comprising first and second inside panels foldable toward each other along a fold line, and first and second inside pockets respectively formed on the first and second inside panels, the folder stuffing apparatus comprising:

(a) a conveyor assembly comprising a conveyor surface disposed along a central longitudinal axis and a conveyor for advancing the folder along the conveyor surface wherein the first and second pockets face outwardly in relation to the conveyor surface, the first pocket being disposed on a first side of the longitudinal axis, and the second pocket being disposed on a second side of the longitudinal axis;

(b) first and second openers mounted above the conveyor surface for respectively opening the first and second pockets;

(c) a first inserter for inserting a first insert material into the first pocket and comprising a first insertion track and a first carriage member slidable along the first insertion track from the second side of the longitudinal axis to the first side of the longitudinal axis; and (d) a second inserter for inserting a second insert material into the second pocket and comprising a second insertion track and a second carriage member slidable along the second insertion track from the first side of the longitudinal axis to the second side of the longitudinal axis.

23. The folder stuffing apparatus according to claim 22 comprising an insert transport surface disposed above the conveyor surface and a side transporter for transferring the first and second insert materials from the insert transport surface to the first and second insertion devices, respectively.

* * * * *